US008339064B2

(12) United States Patent
Ku et al.

(10) Patent No.: US 8,339,064 B2
(45) Date of Patent: Dec. 25, 2012

(54) LED LAMP

(75) Inventors: Chin-Long Ku, Taipei Hsien (TW); Ju Li, Shenzhen (CN)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 358 days.

(21) Appl. No.: 12/817,205

(22) Filed: Jun. 17, 2010

(65) Prior Publication Data

US 2011/0234113 A1 Sep. 29, 2011

(30) Foreign Application Priority Data

Mar. 24, 2010 (CN) ..... 2010 1 0131557

(51) Int. Cl.
*H05B 37/00* (2006.01)

(52) U.S. Cl. ..... 315/291; 315/224; 315/307

(58) Field of Classification Search ..... 315/291, 315/224, 246, 250, 307, 308
See application file for complete search history.

(56) References Cited

U.S. PATENT DOCUMENTS

2007/0080652 A1* 4/2007 Elferich et al. ..... 315/291

* cited by examiner

*Primary Examiner* — David H Vu
(74) *Attorney, Agent, or Firm* — Altis Law Group, Inc.

(57) ABSTRACT

An LED lamp includes two LED modules and a control module. The LED modules emit lights with different color temperatures. The lights are mixed in the LED lamp and form an output light with another color temperature. The control module controls the brightness levels of the lights emitted from the two LED modules to thereby control the color temperature of the output light.

8 Claims, 2 Drawing Sheets

LED LAMP

BACKGROUND

1. Technical Field

The present disclosure relates to light emitting diode (LED) lamps, and particularly to an LED lamp with an adjustable color temperature.

2. Description of Related Art

A conventional LED lamp can only emit light with a constant color temperature, but can not satisfy a requirement that a color temperature of the LED lamp is variable, which may be required for some applications.

It is thus desirable to provide an LED lamp which has an adjustable color temperature to satisfy different requirements.

DETAILED DESCRIPTION

Figure 1:
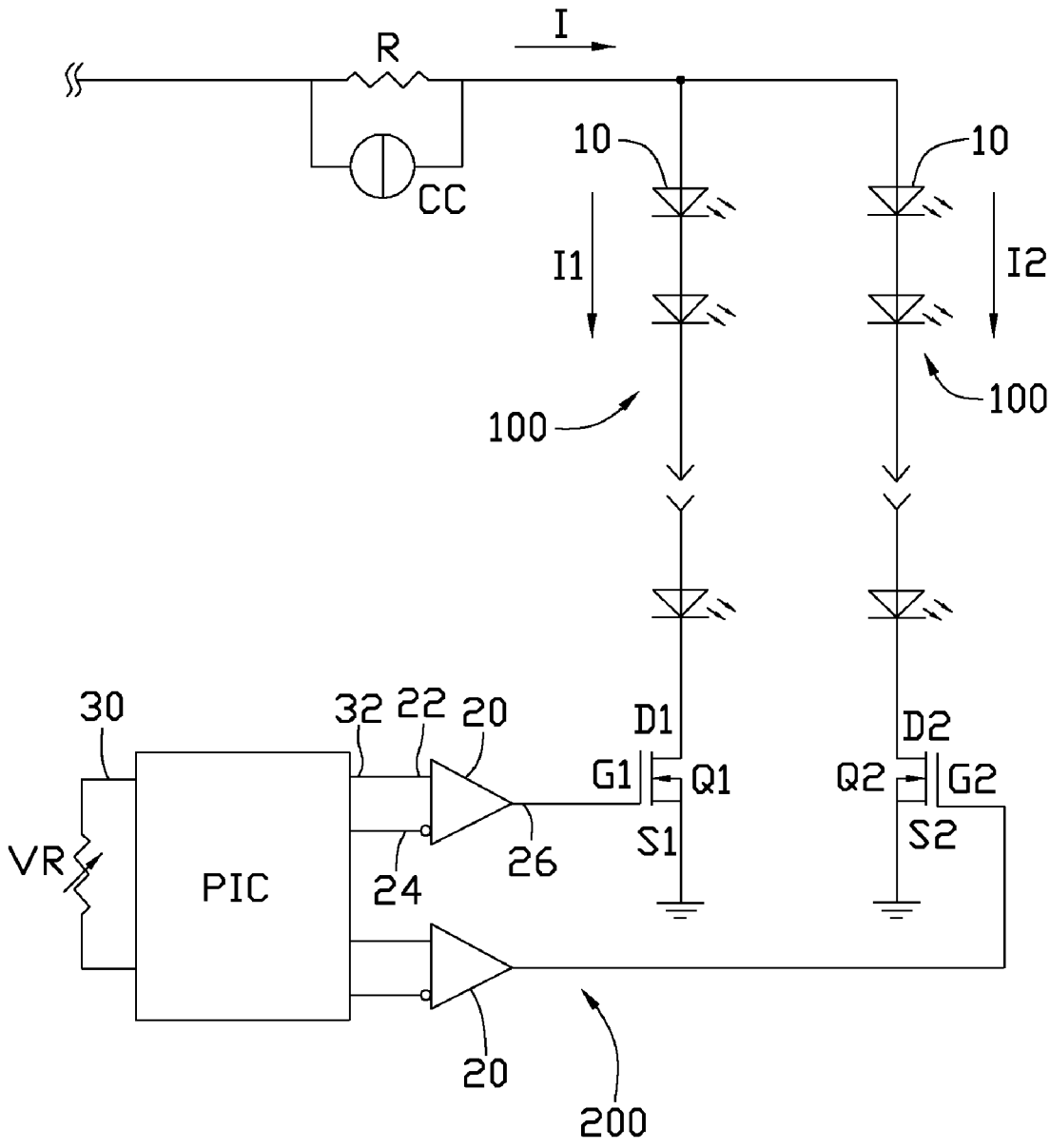
FIG. 1 is a schematic view of a circuit of an LED lamp according to an exemplary embodiment of the present invention.

Referring to FIG. 1, an LED lamp according to an exemplary embodiment of the disclosure can provide illumination light for indoor and outdoor applications, wherein the color temperature of the light of the LED lamp can be adjusted. The LED lamp includes a constant current source CC, two LED modules 100 with different color temperatures, and a control module 200. The constant current source CC and a resistor R are connected in parallel for providing a constant electric current I for the LED modules 100. The control module 200 controls the brightness levels of the lights emitted from the two LED modules 100 to thereby control the color temperatures of the lights.

The two LED modules 100 are connected in parallel. Each of the LED modules 100 includes a plurality of LEDs 10 connected in series and having a same color temperature, wherein the LEDs 10 of a first LED module 100 emit yellow light, and the LEDs 10 of a second LED module 100 emit white light. The LEDs 10 emitting yellow light and the LEDs 10 emitting white light are alternately arranged in the LED lamp, regarding their physical positions in the LED lamp, so that the yellow light and the white light can be mixed in the LED lamp to form a light with a third color temperature within a predetermined color temperature range.

The control module 200 includes an adjusting unit, a main control unit PIC, a comparing element and a driving unit. In this embodiment, the adjusting unit is an adjustable resistor VR, the comparing element includes two comparators 20, and the driving unit includes two metallic oxide semiconductor field effect transistors (MOSFETs) Q1, Q2.

The main control unit PIC includes two input ends 30 and four output ends 32. Each comparator 20 includes two input ends 22, 24 having two opposite polarities and an output end 26. Two ends of the adjustable resistor VR connect with the two input ends 30 of the main control unit PIC. The four output ends 32 of the main control unit PIC connect with the input ends 22, 24 of the two comparators 20. The output ends 26 of the two comparators 20 respectively connect with gate electrodes G1, G2 of the MOSFETs Q1, Q2. Source electrodes S1, S2 of the two MOSFETs Q1, Q2 connect with ground. The LED modules 100 have first ends connecting with drain electrodes D1, D2 of the MOSFETs Q1, Q2, and second ends connecting with the constant current source CC.

Figure 2:
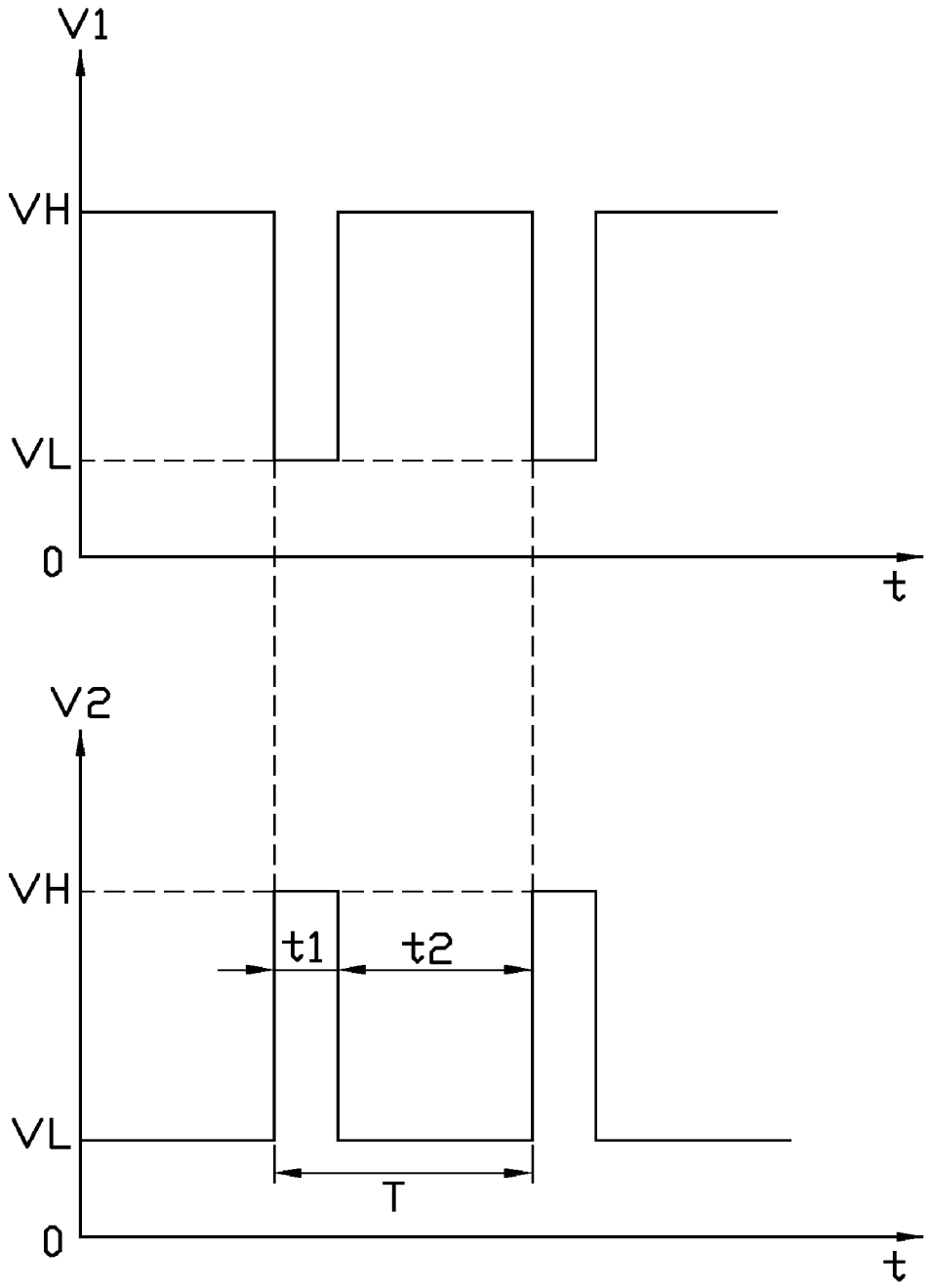
FIG. 2 is a coordinate view of two impulse signals output from two comparators of the circuit of the LED lamp of FIG. 1.

Also referring to FIG. 2, the voltages outputted from the four output ends 32 of the main control unit PIC are inputted to the comparators 20 through the input ends 22, 24 of the comparators 20 and are converted into two output voltages V1, V2 by the comparators 20. The output voltages V1, V2 are outputted from the output ends 26 of the comparators 20. The output voltages V1, V2 are PWM (Pulse Width Modulation) impulse signals. The phases of the output voltages V1, V2 are opposite to each other. The sum of duty cycles of the output voltages V1, V2 is 100%. That is, when the output voltage V1 from the first comparators 20 is a high electric potential VH, the output voltage V2 from the second comparators 20 is a low electric potential VL. The voltages outputted from the main control unit PIC to the input ends 22, 24 of the comparators 20 can be changed by adjusting the value of the adjustable resistor VR, and accordingly the duty cycles of the output voltages V1, V2 outputted from the comparators 20 can be changed by the changing voltages from the main control unit PIC. The output voltages V1, V2 from the comparators 20 can drive the gate electrodes G1, G2 of the MOSFETs Q1, Q2, and make the MOSFETs Q1, Q2 be in ON-state. The ON-state time of the MOSFETs Q1, Q2 can be controlled by changing the duty cycles of the output voltages V1, V2, and electric currents I1, I2 flowing through the drain electrodes D1, D2 of the MOSFETs Q1, Q2 and the LED modules 100 are accordingly controlled to thereby regulate brightness levels of the lights emitted from the LED modules 100. In addition, the electric currents I1, I2 flowing through the LED modules 100 increase along with increases of the duty cycles of the corresponding output voltages V1, V2 from the comparators 20, and the brightness levels of the lights emitted from the LED modules 100 increase along with increases of the electric currents I1, I2 flowing through the LED modules 100. Thus the brightness levels of the lights emitted from the LED modules 100 can be regulated by changing the duty cycles of the output voltages V1, V2 from the comparators 20.

The sum of the electric currents I1, I2 flowing through the LED modules 100 is equal to the electric current I supplied by the constant current source CC. When the electric current I1 flowing through the first LED modules 100 increases, the electric current I2 flowing through the second LED modules 100 decreases. Since the phases of the output voltages V1, V2 from the comparators 20 are opposite to each other, the brightness levels of the lights emitted from the LED modules 100 are complementary. That is, if the brightness level of the yellow light emitted from the first LED module 100 increases, the brightness level of the white light emitted from the second LED module 100 decreases accordingly. In a word, the duty cycles of the output voltages V1, V2 from the comparators 20 can be continuously changed and regulated by adjusting the value of the adjustable resistor VR, and the electric currents I1, I2 flowing through the LED modules and accordingly the brightness levels of the lights emitted from the LED modules 100 can be continuously changed thereby, to obtain a desired color temperature for the LED lamp.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp, comprising:

two LED modules emitting lights with different color temperatures, the lights mixed in the LED lamp and forming an output light with another color temperature; and a control module for controlling the brightness levels of the lights emitted from the two LED modules to thereby control the color temperature of the output light;

wherein the control module outputs two PWM (Pulse Width Modulation) impulse signals respectively to the two LED modules to control the brightness levels of the lights emitted from the two LED modules, the phases of the PWM impulse signals are opposite to each other, and the sum of duty cycles of the PWM impulse signals is 100%.

2. The LED lamp as described in claim 1, wherein the brightness levels of the lights emitted from the LED modules increase along with increases of the duty cycles of the PWM impulse signals and decrease along with decreases of the duty cycles of the PWM impulse signals.

3. The LED lamp as described in claim 2, wherein the two LED modules are connected in parallel and each LED module comprises a plurality of LEDs connected in series.

4. The LED lamp as described in claim 3, further comprising a constant current source for providing a constant electric current for the LED modules.

5. The LED lamp as described in claim 4, wherein the control module controls the brightness levels of the lights emitted from the LED modules by controlling electric currents flowing respectively through the LED modules, and the sum of the electric currents flowing through the LED modules is equal to the constant electric current supplied by the constant current source.

6. The LED lamp as described in claim 5, wherein the control module comprises an adjusting unit, a main control unit connecting with the adjusting unit, a comparing element connecting with the main control unit, and a driving unit connecting with the comparing element, each of the LED modules having a first end connecting with the driving unit and a second end connecting with the constant current source, the comparing element outputting two output voltages for driving the driving unit, the PWM impulse signals being obtained from the two output voltages, the duty cycles of the PWM impulse signals being variable by adjusting the adjusting unit.

7. The LED lamp as described in claim 6, wherein the adjusting unit is an adjustable resistor, the comparing element comprises two comparators, each comparator comprises two input ends and an output end, the driving unit comprises two MOSFETs, the main control unit comprises two input ends connecting with two ends of the adjustable resistor and four output ends connecting with the input ends of the comparators, the output ends of the two comparators respectively connect with gate electrodes of the MOSFETs, source electrodes of the two MOSFETs connect with ground, and the first ends of the LED modules respectively connect with drain electrodes of the MOSFETs.

8. The LED lamp as described in claim 3, wherein physical positions of the LEDs of one of the two LED modules in the LED lamp are alternated with those of the LEDs of the other one of the two LED modules in the LED lamp.

* * * * *